US011273643B2

(12) United States Patent
Andoh et al.

(10) Patent No.: US 11,273,643 B2
(45) Date of Patent: Mar. 15, 2022

(54) LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventors: Shiomi Andoh, Kanagawa (JP); Takayuki Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/089,808

(22) Filed: Nov. 5, 2020

(65) Prior Publication Data

US 2021/0197563 A1 Jul. 1, 2021

(30) Foreign Application Priority Data

Dec. 25, 2019 (JP) ..... JP2019-234061

(51) Int. Cl.
*B41J 2/14* (2006.01)

(52) U.S. Cl.
CPC ..... *B41J 2/14274* (2013.01); *B41J 2/14032* (2013.01); *B41J 2/14201* (2013.01)

(58) Field of Classification Search
CPC . B41J 2/14274; B41J 2/14032; B41J 2/14201
See application file for complete search history.

(56) References Cited

U.S. PATENT DOCUMENTS 6,361,155 B1 * 3/2002 Kanda ..... B41J 2/14274 347/65
2013/0076832 A1 3/2013 Sayama
2015/0246536 A1 9/2015 Yoshida
2016/0082728 A1 3/2016 Kohda et al.
2016/0096369 A1 4/2016 Shimizu et al.
2016/0185113 A1 6/2016 Yoshida et al.
2017/0087865 A1 3/2017 Yoshida et al.
2017/0096015 A1 4/2017 Odaka et al.
2017/0120602 A1 5/2017 Nakai et al.
2017/0157924 A1 6/2017 Otome et al.
2017/0225485 A1 8/2017 Nakai
2017/0297333 A1 10/2017 Kohda et al.
2018/0194135 A1 7/2018 Iwama et al.
2018/0257374 A1 9/2018 Yoshida et al.
2018/0272730 A1 9/2018 Odaka et al.
2018/0272740 A1 9/2018 Otome et al.
2018/0272743 A1 9/2018 Nakai et al.
2019/0084313 A1 3/2019 Kohda et al.
2019/0358953 A1 11/2019 Iwata et al.
2020/0094573 A1 3/2020 Kohda et al.
(Continued)

FOREIGN PATENT DOCUMENTS

JP 11-157063 6/1999

*Primary Examiner* — Geoffrey S Mruk
(74) *Attorney, Agent, or Firm* — Xsensus LLP

(57) ABSTRACT

A liquid discharge head includes a nozzle from which a liquid is discharged, a pressure chamber communicating with the nozzle, to which the liquid is supplied, a dummy channel not communicating with the nozzle and adjacent to the pressure chamber, the dummy channel being a sealed place to which the liquid is not supplied, and a diaphragm configured to define a displaceable wall of the pressure chamber and a wall of the dummy channel. The wall of the dummy channel defined by the diaphragm includes a through hole.

12 Claims, 9 Drawing Sheets

(56) References Cited

U.S. PATENT DOCUMENTS

| | | | |
|---|---|---|---|
| 2020/0094595 | A1 | 3/2020 | Iwama et al. |
| 2020/0282740 | A1 | 9/2020 | Kohda et al. |
| 2020/0331262 | A1 | 10/2020 | Andou et al. |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-234061, filed on Dec. 25, 2019, in the Japan Patent Office, the entire disclosures of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head discharges a liquid from nozzles. The liquid discharge head includes pressure chambers and a dummy channel. The pressure chambers communicating with the nozzles. The dummy channel is arranged on a side of the pressure chambers in a nozzle array direction in which the nozzles are arrayed. The pressure chamber is also referred to as an individual chamber.

The liquid discharge head includes a channel substrate that includes a dummy pressure chamber and a dummy supply port. The dummy pressure chamber and the dummy supply port are separated from the pressure chambers and a common chamber. Further, the dummy pressure chamber may include an air release port through which the dummy pressure chamber communicates with atmosphere.

SUMMARY

In an aspect of this disclosure, a liquid discharge head includes a nozzle from which a liquid is discharged, a pressure chamber communicating with the nozzle, to which the liquid is supplied, a dummy channel not communicating with the nozzle and adjacent to the pressure chamber, the dummy channel being a sealed place to which the liquid is not supplied, and a diaphragm configured to define a displaceable wall of the pressure chamber and a wall of the dummy channel. The wall of the dummy channel defined by the diaphragm includes a through hole.

In another aspect of this disclosure, a liquid discharge head includes: a nozzle from which a liquid is discharged, a pressure chamber communicating with the nozzle, to which the liquid is supplied, a dummy channel not communicating with the nozzle and adjacent to the pressure chamber, the dummy channel being a sealed place to which the liquid is not supplied, a diaphragm configured to define a displaceable wall of the pressure chamber and a wall of the dummy channel, and a channel plate bonded to the diaphragm, the channel plate including the pressure chamber and the dummy channel. The wall of the dummy channel defined by the diaphragm includes a through hole, and the channel plate includes a communication hole communicating between the through hole and the dummy channel.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
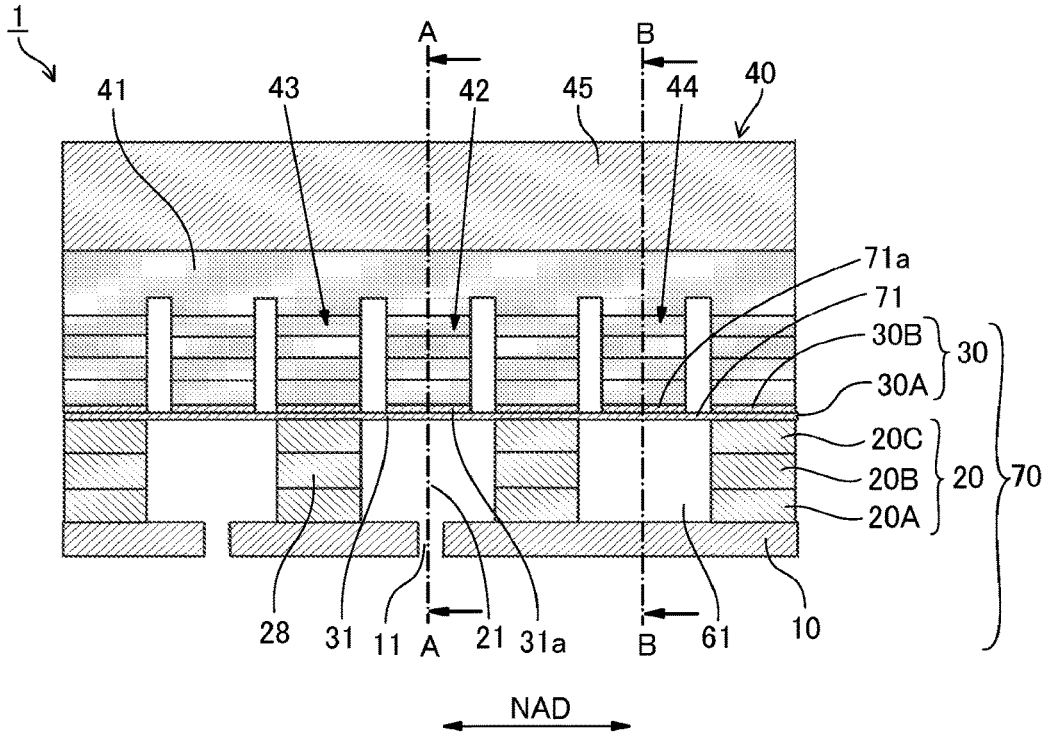
FIG. 1 is a cross-sectional view of a liquid discharge head according to a first embodiment of the present disclosure in a nozzle array direction of the liquid discharge head.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A liquid discharge head 1 according to a first embodiment of the present disclosure is described with reference to FIGS. 1 to 3. Hereinafter, the "liquid discharge head" is simply referred to as the "head."

FIG. 1 is a cross-sectional view of a portion of the head 1 along a nozzle array direction indicated by arrow "NAD" in FIG. 1. Nozzles 11 of the head 1 are arrayed in the nozzle array direction NAD.

Figure 2:
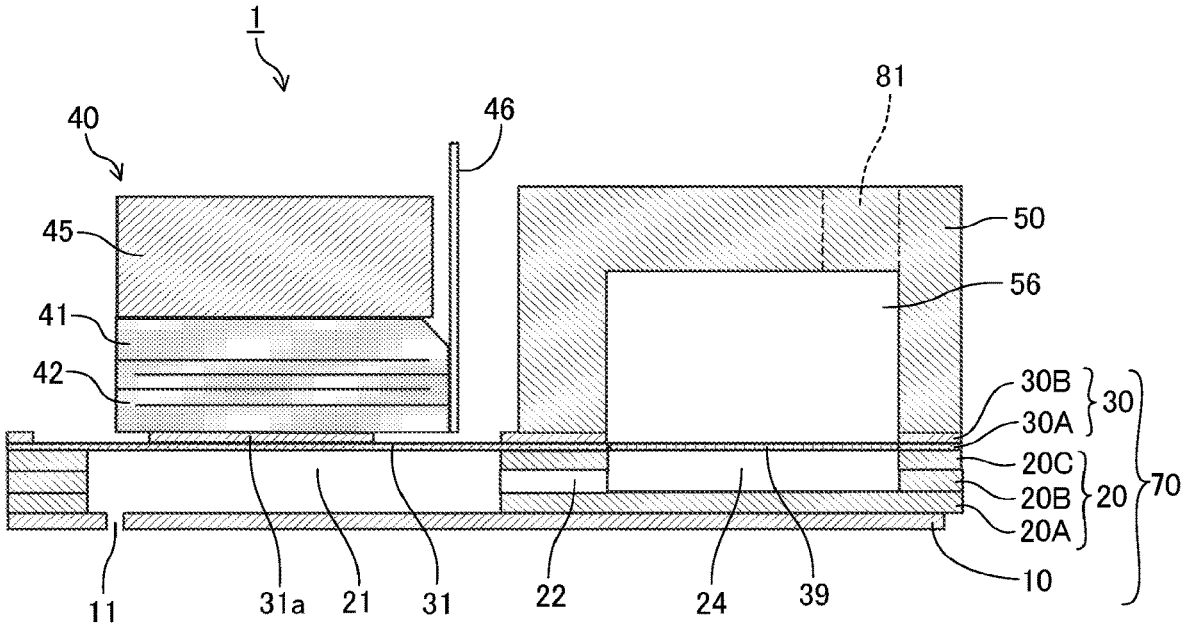
FIG. 2 is a cross-sectional view of the liquid discharge head along a line A-A in a direction perpendicular to the nozzle array direction.
Figure 3:
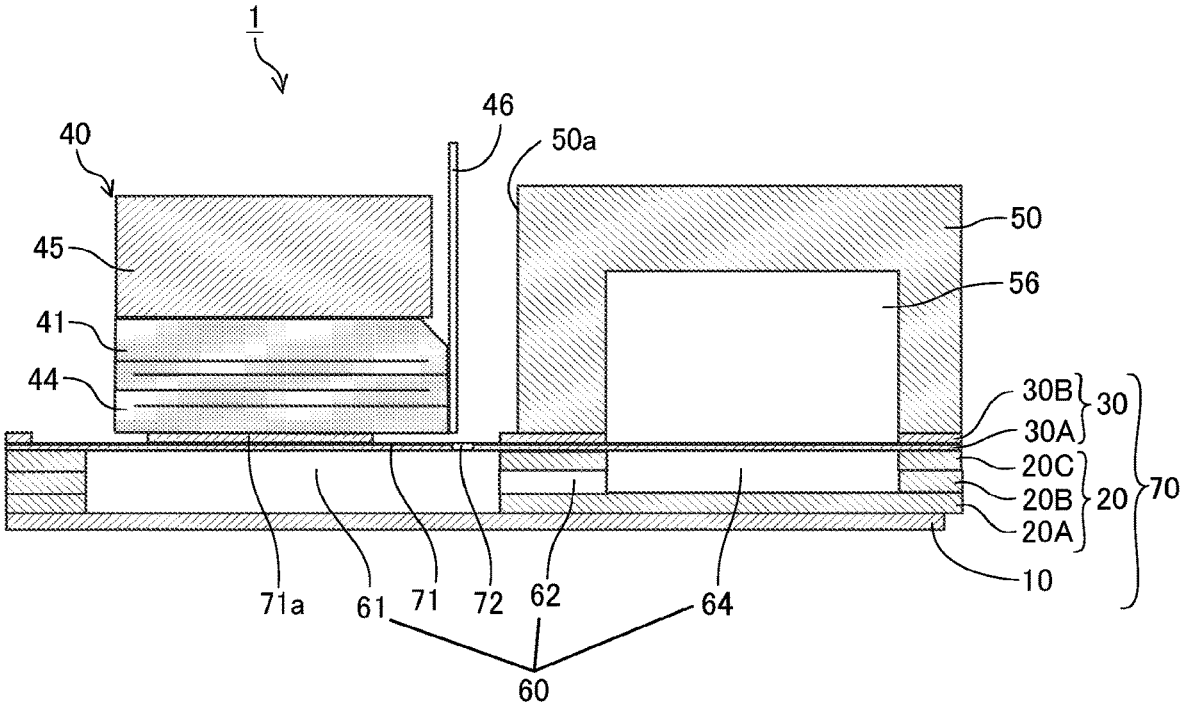
FIG. 3 is a cross-sectional view of the liquid discharge head along a line B-B in the direction perpendicular to the nozzle array direction.

FIG. 2 is a cross-sectional view of the head 1 along a line A-A in a direction perpendicular to the nozzle array direction NAD. FIG. 3 is a cross-sectional view of the head 1 along a line B-B in a direction perpendicular to the nozzle array direction NAD.

The head 1 includes a nozzle plate 10, a channel plate 20, and a diaphragm 30 that are laminated one on another and bonded to each other. The head 1 further includes a piezoelectric actuator 40 and a common channel member 50. The piezoelectric actuator 40 displaces a vibration region 31 of the diaphragm 30. The vibration region 31 is also referred to as a diaphragm region or vibration plate. The common channel member 50 also serves as a frame of the head 1.

The nozzle plate 10 includes a nozzle array in which a plurality of nozzles 11 are arrayed in the nozzle array direction NAD.

The channel plate 20 includes a plurality of pressure chambers 21, individual supply channels 22, and one of more intermediate supply channels 24. The plurality of pressure chambers 21 respectively communicates with the plurality of nozzles 11. The plurality of individual supply channels 22 also serve as fluid restrictors respectively communicating with the plurality of pressure chambers 21. One or more of the intermediate supply channels 24 respectively communicate with one or more of the individual supply channels 22. Adjacent pressure chambers 21 are separated by a partition wall 28.

The head 1 according to the first embodiment includes three plate members 20A to 20C laminated one on another from the nozzle plate 10 to form the channel plate 20.

The diaphragm 30 includes a plurality of displaceable vibration regions 31 that form walls of the pressure chambers 21 in the channel plate 20. Here, the diaphragm 30 has a two-layer structure and includes a first layer 30A forming a thin portion and a second layer 30B forming a thick portion in this order from a side facing the channel plate 20. Note that the structure of the diaphragm 30 is not limited to such a two-layer structure but may be any suitable layer structure.

The displaceable vibration region 31 is formed in a portion corresponding to the pressure chamber 21 in the first layer 30A that is a thin portion. The vibration region 31 includes an island-shaped convex portion 31*a* that is a thick portion bonded to the piezoelectric actuator 40 in the second layer 30B.

The head 1 includes the piezoelectric actuator 40 on a side of the diaphragm 30 opposite a side facing the pressure chamber 21. The piezoelectric actuator 40 includes an electromechanical transducer element (piezoelectric element 42) serving as a driving device to deform the vibration region 31 of the diaphragm 30. The driving device is also referred to as an actuator device or a pressure generation device.

In the piezoelectric actuator 40, a piezoelectric member 41 bonded on a base 45 is grooved by half-cut dicing, to form a desired number of columnar piezoelectric elements 42, a column 43, and a dummy piezoelectric element 44 at predetermined intervals in a comb shape.

The piezoelectric element 42 is a piezoelectric element that displaces the vibration region 31 when a drive voltage is applied to the piezoelectric element 42. The column 43 is a piezoelectric element that supports the partition wall 28 between the pressure chambers 21 to which the drive voltage is not applied. The dummy piezoelectric element 44 is a piezoelectric element corresponding to the dummy pressure chamber 61.

The piezoelectric element 42 is bonded to a convex portion 31*a* in the vibration region 31 of the diaphragm 30. The columns 43 are bonded to portions of the diaphragm 30 corresponding to the partition walls 28 with an adhesive.

The piezoelectric member 41 includes piezoelectric layers and internal electrodes alternately laminated on each other. Each internal electrode is led out to an end surface of the piezoelectric member 41 and connected to an external electrode (end surface electrode). The external electrode is connected with a flexible wiring 46 (see FIG. 2).

The common channel member 50 defines a common supply channel 56. The common supply channel 56 communicates with the intermediate supply channel 24 via a filter 39 in the diaphragm 30. The common channel member 50 includes a supply port 81 to supply a liquid to the common supply channel 56 from an exterior of the head 1. Thus, the common channel member 50 includes the common supply channel 56 configured to supply the liquid to the pressure chamber 21.

In the head 1, for example, the voltage to be applied to the piezoelectric element 42 is lowered from a reference potential (intermediate potential) so that the piezoelectric element 42 contracts to pull the vibration region 31 of the diaphragm 30 to increase the volume of the pressure chamber 21. As a result, liquid flows into the pressure chamber 21.

Then, the voltage to be applied to the piezoelectric element 42 is increased to expand the piezoelectric element 42 in a direction of lamination. The vibration region 31 of the diaphragm 30 is deformed in a direction toward the nozzle 11 to reduce the volume of the pressure chamber 21. Thus, the liquid in the pressure chamber 21 is pressurized and discharged from the nozzle 11 of the head 1.

Next, a configuration of the dummy channel of the head 1 according to the first embodiment of the present disclosure is described with reference to FIG. 3.

As illustrated in FIG. 1, the dummy channel 60 is arranged at an end of an array of the pressure chambers 21 in the nozzle array direction NAD. As illustrated in FIG. 3, the dummy channel 60 includes a dummy pressure chamber 61, a dummy individual supply channel 62, and a dummy intermediate supply channel 64.

A shape of the dummy channel 60 is the same as a shape of the pressure chamber 21, the individual supply channel 22, and the intermediate supply channel 24 as illustrated in FIGS. 2 and 3. However, the shape of the dummy channel 60 may be different from the shape of the pressure chamber 21, the individual supply channel 22, and the intermediate supply channel 24.

The nozzle plate 10 does not include the nozzle 11 in a portion corresponding to the dummy pressure chamber 61. A dummy vibration region 71 of the diaphragm 30 forms a part of a wall of the dummy pressure chamber 61. The dummy vibration region 71 includes a convex portion 71*a*, and the dummy piezoelectric element 44 is bonded to the convex portion 71*a*.

Further, the head 1 in the first embodiment includes the common supply channel 56 formed up to a position of the dummy intermediate supply channel 64 in the nozzle array direction NAD. The diaphragm 30 separates the common supply channel 56 and the dummy intermediate supply channel 64.

Thus, the dummy channel 60 does not communicate with the nozzle 11 and is a space to which no liquid is supplied.

Further, the head 1 in the first embodiment includes a through hole 72 in the dummy vibration region 71 of the diaphragm 3 as illustrated in FIG. 3. The through hole 72 communicates with a space (atmosphere) in an insertion port 50*a* of the piezoelectric actuator 40 in the common channel member 50. Thus, the through hole 72 in the diaphragm 30 is between the dummy piezoelectric element 44 and the common channel member 50 as illustrated in FIG. 3.

Figure 4:
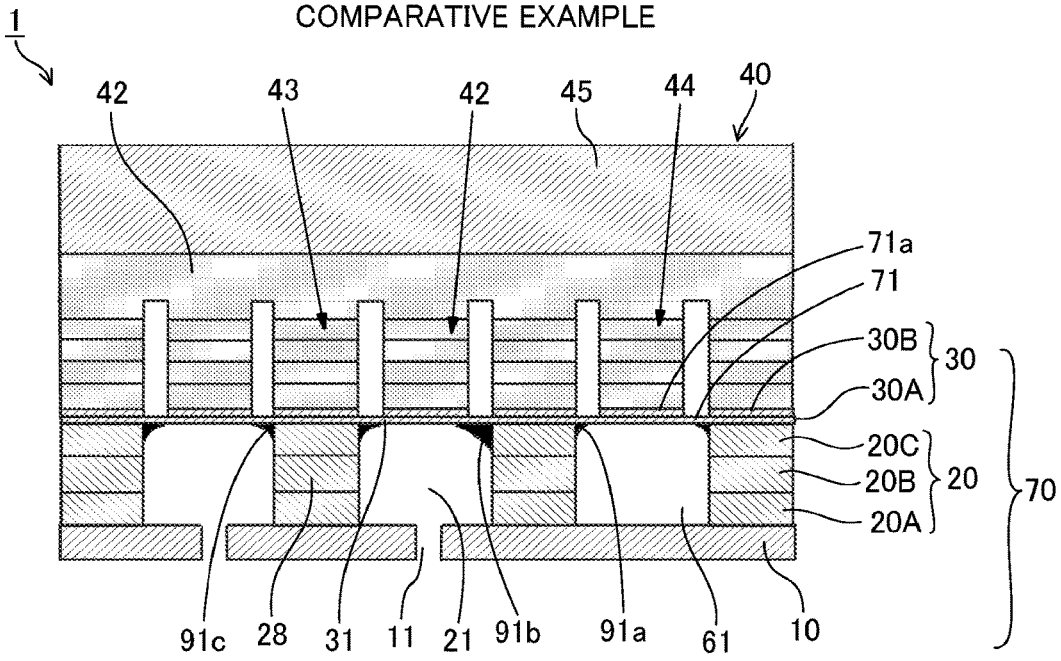
FIG. 4 is a schematic cross-sectional view of the liquid discharge head of a comparative example in which an adhesive overflown from pressure chambers and a dummy pressure chamber.

Next, a function of the head 1 according to the first embodiment is described with reference to a comparative example of FIG. 4. FIG. 4 is a schematic cross-sectional view of the head 1 of the comparative example in which an adhesive spilled out of the pressure chambers 21 and the dummy pressure chamber 61.

In a manufacturing process of the head 1, a channel unit 70 is formed by bonding the nozzle plate 10, the channel plate 20, and the diaphragm 30 with an adhesive. Further, the piezoelectric actuator 40 is bonded to the channel unit 70 with an adhesive, and the common channel member 50 is further bonded to the channel unit 70 with an adhesive as illustrated in FIG. 3.

When the nozzle plate 10, the channel plate 20, and the diaphragm 30 are bonded with an adhesive to form the channel unit 70, the adhesive between the diaphragm 30 and the channel plate 20 overflows into the pressure chamber 21 and dummy pressure chamber 61 as illustrated in FIG. 4. At the time of bonding, in a case of the head 1 in the comparative example as illustrated in FIG. 4, the dummy channel 60 becomes a closed space. The head 1 in the comparative example does not include the through hole 72 (see FIG. 3) communicating with the dummy channel 60.

Therefore, an internal pressure in the dummy pressure chamber 61 increases that reduces an adhesive 91*a* that overflows into the dummy pressure chamber 61 as illustrated in FIG. 4. On the other hand, the adhesive 91*b* that overflows into the pressure chamber 21 increases as illustrated in FIG. 4. The pressure chamber 21 is adjacent to the dummy pressure chamber 61.

As a result, an amount of the adhesive 91*b* overflown into the pressure chamber 21 adjacent to the dummy pressure chamber 61 is different from (larger than) an amount of the adhesive 91*c* overflown into the pressure chamber 21 not adjacent to the dummy pressure chamber 61. Therefore, displacement characteristics of the vibration region 31 forming the wall of the pressure chamber 21 differ between the pressure chambers 21 so that discharge characteristics of the pressure chambers 21 also vary.

Conversely, the head 1 according to the first embodiment includes the through hole 72 in the diaphragm 30 through which the dummy channel 60 communicates with the atmosphere so that the dummy channel 60 is not a closed space.

Thus, the head 1 in the first embodiment can prevent an increase in the internal pressure in the dummy pressure chamber 61 and prevent an increase in the amount of the adhesive 91*b* overflown into the pressure chamber 21 adjacent to the dummy pressure chamber 61. Thus, the head 1 according to the first embodiment can reduce unevenness of the discharge characteristics of the pressure chambers 21.

If an air release port is formed on a side surface of the head 1 (or a side wall of the dummy channel 60) to open the dummy channel 60 to atmosphere to avoid a closed state of the dummy channel 60, the liquid can easily enter to the dummy channel 60 via the air release port as the liquid is discharged from the head 1.

Conversely, the head 1 in the first embodiment includes the through hole 72 communicating with the insertion port 50*a* of the piezoelectric actuator 40 of the common channel member 50 so that the head 1 can prevent the liquid from entering into the through hole 72.

Figure 5:
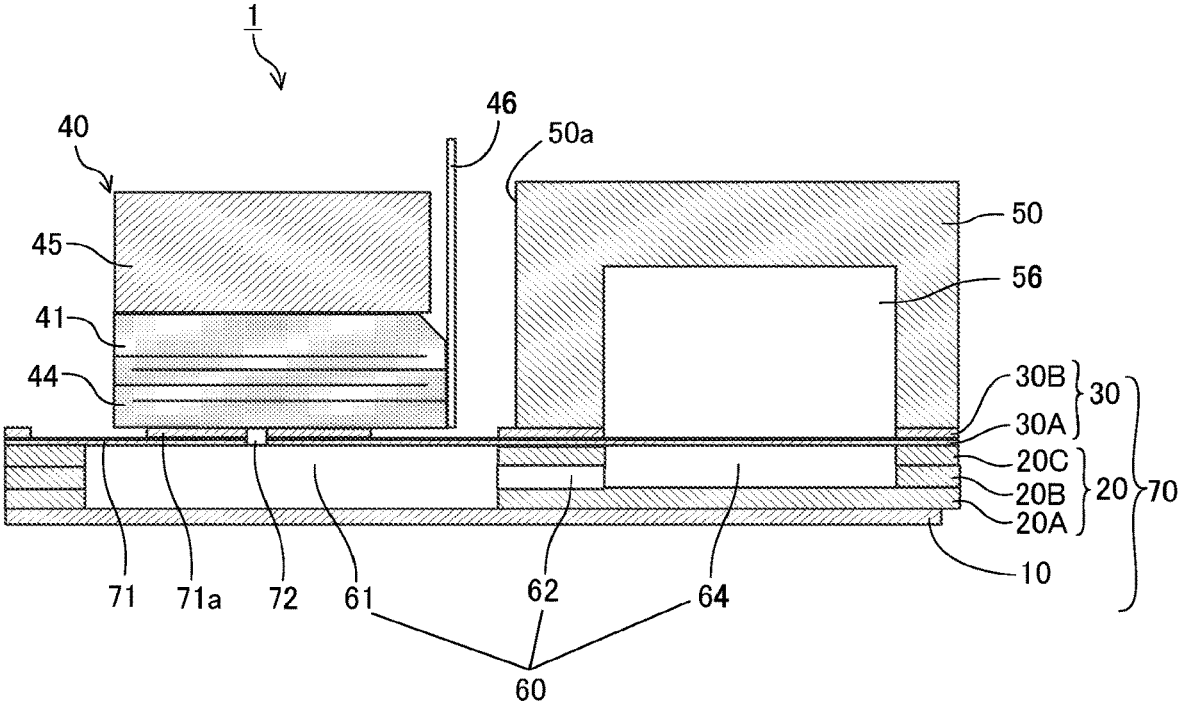
FIG. 5 is a cross-sectional view of the liquid discharge head according to a second embodiment of the present disclosure in the direction perpendicular to the nozzle array direction.

Next, the head 1 according to a second embodiment of the present disclosure is described with reference to FIG. 5. FIG. 5 is a cross-sectional view of the head 1 according to the fifth embodiment in the direction perpendicular to the nozzle array direction NAD.

The head 1 according to the second embodiment includes the through hole 72 penetrating through the dummy vibration region 71 and the convex portion 71*a* of the diaphragm 30.

Thus, the dummy channel 60 is open to the atmosphere through the through hole 72 before the piezoelectric actuator 40 is bonded to the diaphragm 30. Thus, as similar to the head 1 in the first embodiment, the head 1 in the second embodiment can prevent an increase in the internal pressure in the dummy pressure chamber 61 and prevent an increase in the amount of the adhesive 91*b* overflown into the pressure chamber 21 adjacent to the dummy pressure chamber 61. Thus, the head 1 according to the second embodiment can reduce unevenness of the discharge characteristics of the pressure chambers 21.

After the nozzle plate 10, the channel plate 20, and the diaphragm 30 are bonded with an adhesive to form the channel unit 70, the dummy piezoelectric element 44 is bonded to the convex portion 71*a* of the dummy vibration region 71 of the diaphragm 30 with an adhesive. The through hole 72 used as the air release port is thus sealed (closed) by the dummy piezoelectric element 44 bonded to the convex portion 71*a* of the dummy vibration region 71.

Thus, the dummy channel 60 is a sealed space (closed space) after the through hole 72 is sealed by the dummy piezoelectric element 44. That is, the dummy piezoelectric element 44 is configured to seal the through hole 72. Therefore, the through hole 72 is sealed by the dummy piezoelectric element 44 to seal the dummy channel 60 to form the sealed space. Thus, the dummy piezoelectric element 44 seals the through hole 72.

Thus, the liquid does not enter the through hole 72 of the head 1 according to the second embodiment.

Figure 6:
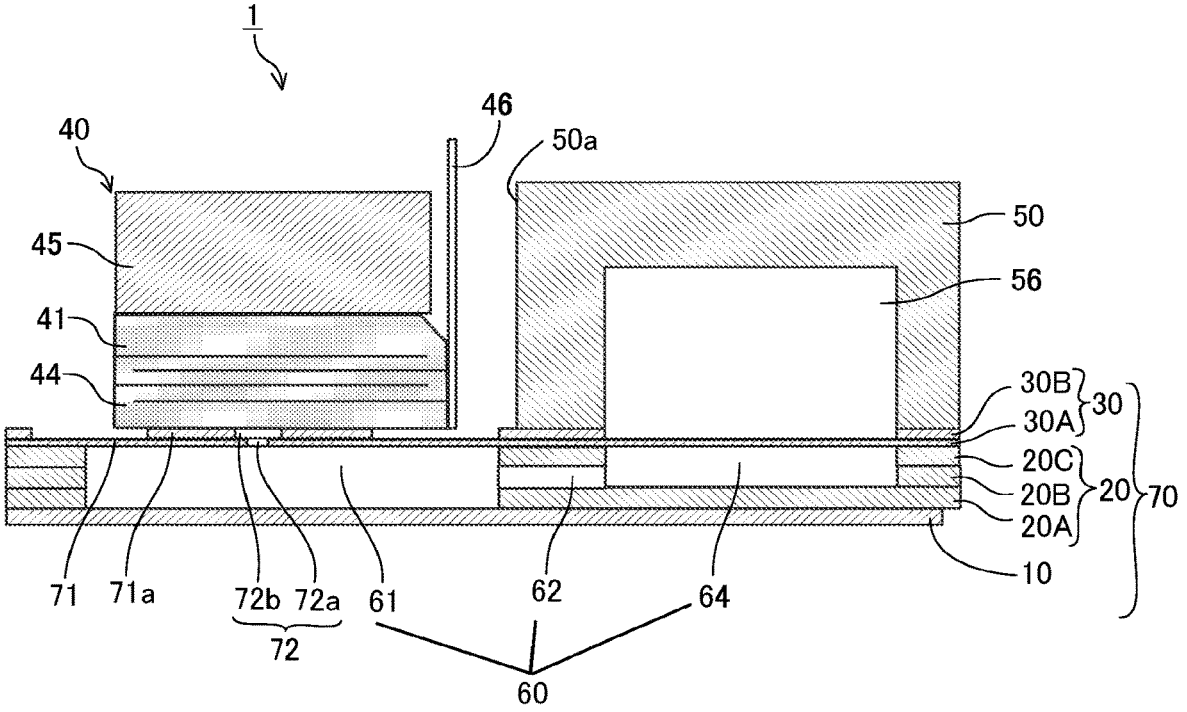
FIG. 6 is a cross-sectional view of the liquid discharge head according to a third embodiment of the present disclosure in the direction perpendicular to the nozzle array direction.

Next, the head 1 according to a third embodiment of the present disclosure is described with reference to FIG. 6. FIG. 6 is a cross-sectional view of the head 1 according to the third embodiment in the direction perpendicular to the nozzle array direction NAD.

The head 1 according to the third embodiment includes the through hole 72 penetrating through the convex portion 71*a* and the dummy vibration region 71 of the diaphragm 30. The through hole 72 includes a first through hole 72*a* in a portion of the first layer 30A of the diaphragm 30 and a second through hole 72*b* in a portion of the second layer 30B (convex portion 71*a*) of the diaphragm 30. An opening area of the second through hole 72*b* is larger than an opening area of the first through hole 72*a*.

Therefore, the through hole 72 according to the third embodiment has a configuration in which the opening area gradually decreases stepwise from the dummy piezoelectric element 44 toward a wall surface (an upper surface of the nozzle plate 10 in FIG. 6, for example) of the dummy channel 60.

Thus, the head 1 according to the third embodiment can reduce an amount of the adhesive that overflows into the dummy pressure chamber 61 when the dummy piezoelectric element 44 is bonded to the convex portion 71*a* of the dummy vibration region 71 with the adhesive. The through hole 72 may have a configuration in which the opening area gradually and continuously decreases toward the wall surface of the dummy channel 60.

Figure 7:
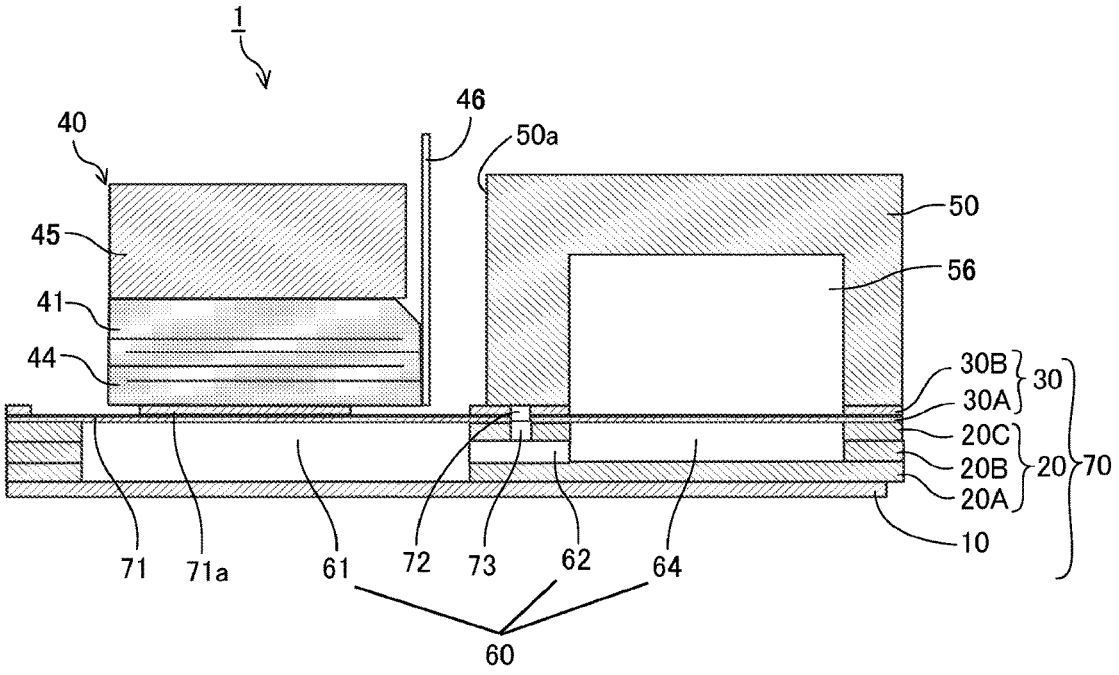
FIG. 7 is a cross-sectional view of the liquid discharge head according to a fourth embodiment of the present disclosure along the direction perpendicular to the nozzle array direction.

Next, the head 1 according to a fourth embodiment of the present disclosure is described with reference to FIG. 7. FIG. 7 is a cross-sectional view of the head 1 according to the fourth embodiment in the direction perpendicular to the nozzle array direction NAD.

The head 1 according to the fourth embodiment includes the through hole 72 in a region of the diaphragm 30 to which the common channel member 50 is bonded. The plate member 20C forming the channel plate 20 includes a communication hole 73 to connect the through hole 72 and the dummy individual supply channel 62.

Thus, the dummy channel 60 is open to the atmosphere through the through hole 72 and the communication hole 73 before the piezoelectric actuator 40 is bonded to the diaphragm 30. Thus, as similar to the head 1 in the first embodiment, the head 1 in the fourth embodiment can prevent an increase in the internal pressure in the dummy pressure chamber 61 and prevent an increase in the amount of the adhesive 91*b* overflown into the pressure chamber 21 adjacent to the dummy pressure chamber 61. Thus, the head 1 according to the fourth embodiment can reduce unevenness of the discharge characteristics of the pressure chambers 21.

After the nozzle plate 10, the channel plate 20, and the diaphragm 30 are bonded with an adhesive to form the channel unit 70, the common channel member 50 is bonded to the diaphragm 30 with an adhesive. Thus, the through hole 72 used as the air release port is thus sealed (closed) by the common channel member 50 bonded to the diaphragm 30.

Thus, the dummy channel 60 is a sealed space (closed space) after the through hole 72 is sealed by the common channel member 50. That is, the common channel member 50 is configured to seal the through hole 72. Therefore, the through hole 72 is sealed by the common channel member 50 to seal the dummy channel 60 to form the sealed space. Thus, the common channel member 50 seals the through hole 72.

Thus, the liquid does not enter the through hole 72 of the head 1 according to the second embodiment.

Figure 8:
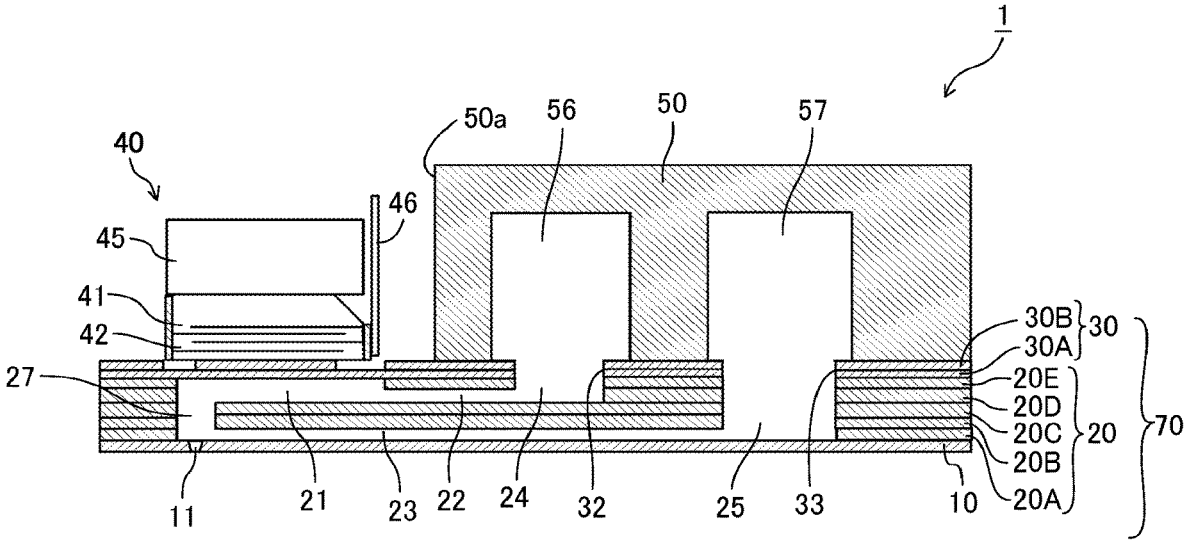
FIG. 8 is a cross-sectional view of the liquid discharge head at a position of a pressure chamber according to a fifth embodiment of the present disclosure along the direction perpendicular to the nozzle array direction.
Figure 9:
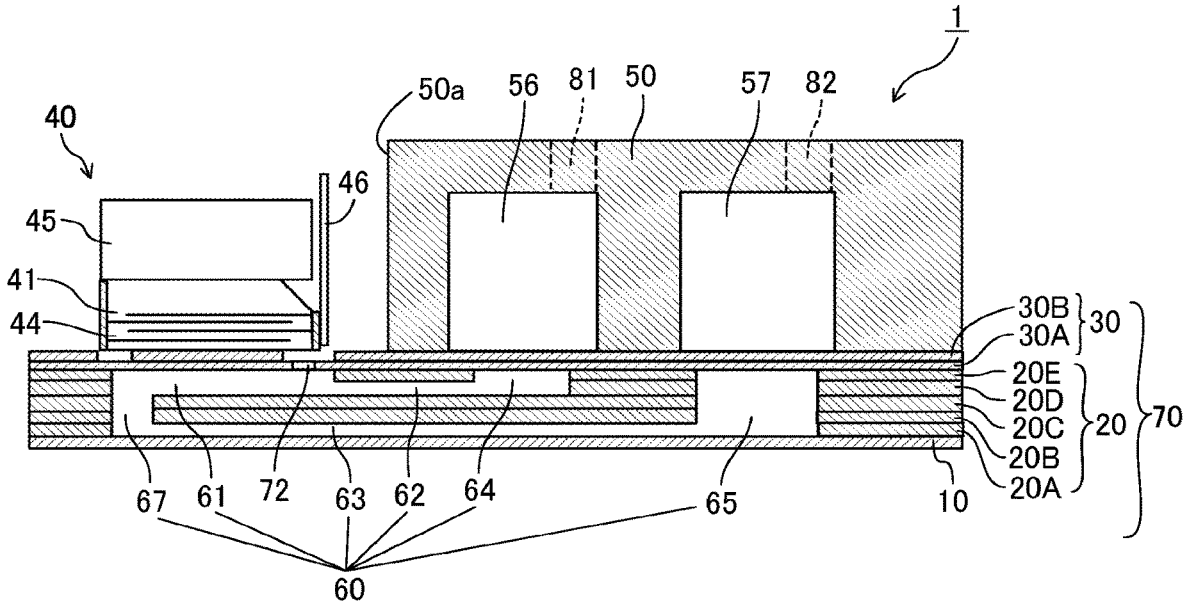
FIG. 9 is a cross-sectional view of the liquid discharge head at a position of a dummy pressure chamber of the liquid discharge head according to the fifth embodiment along the direction perpendicular to the nozzle array direction.

Next, the head 1 according to a fifth embodiment of the present disclosure is described with reference to FIGS. 8 and 9. FIG. 8 is a cross-sectional view of the head 1 at a position of the pressure chambers 21 of the head 1 according to the fifth embodiment along the direction perpendicular to the nozzle array direction NAD. FIG. 9 is a cross-sectional view of the head 1 at a position of the dummy pressure chamber 61 of the head 1 according to the fifth embodiment along the direction perpendicular to the nozzle array direction NAD.

The head 1 according to the fifth embodiment is the head 1 including a circulation-type pressure chamber 21. The head 1 includes the nozzle plate 10, the channel plate 20, and the diaphragm 30 laminated one on another and bonded to each other. The head 1 further includes the piezoelectric actuator 40 and the common channel member 50. The piezoelectric actuator 40 displaces the vibration region 31 of the diaphragm 30. The common channel member 50 also serves as a frame of the head 1.

The nozzle plate 10 includes a nozzle array in which a plurality of nozzles 11 are arrayed in the nozzle array direction NAD.

The channel plate 20 includes the plurality of pressure chambers 21, the individual supply channels 22, and one of more intermediate supply channels 24. The plurality of pressure chambers 21 communicates with the plurality of nozzles 11 via a plurality of nozzle communication channels 27, respectively. The individual supply channels 22 also serve as fluid restrictors respectively communicating with the plurality of pressure chambers 21. One or more of the intermediate supply channels 24 respectively communicate with one or more of the individual supply channels 22.

The channel plate 20 includes individual collection channels 23 and one or more intermediate collection channels 25. The individual collection channels 23 serve as fluid restrictors and communicate with the plurality of pressure chambers 21 via the nozzle communication channels 27. One or more of the intermediate collection channels 25 respectively communicate with one or more of the individual collection channels 23.

The head 1 according to the fifth embodiment includes five plate members 20A to 20E laminated one on another from the nozzle plate 10 to form the channel plate 20.

It is omitted in a following description that configurations of the diaphragm 30 and the piezoelectric actuator 40 of the head 1 according to the fifth embodiment similar to the configurations of the diaphragm 30 and the piezoelectric actuator 40 of the head 1 according to the first embodiment.

The common channel member 50 includes a common supply channel 56 and a common collection channel 57. The common supply channel 56 communicates with the intermediate supply channel 24 via a supply opening 32 in the diaphragm 30. The common collection channel 57 communicates with the intermediate collection channel 25 via a collection opening 33 in the diaphragm 30.

The common supply channel 56 is connected to a supply side of an external liquid circulation device through the supply port 81 (see FIG. 9). The common collection channel 57 is connected to a collection side of the external liquid circulation device through the collection port 82 (see FIG. 9).

In the head 1 according to the fifth embodiment, the liquid supplied from an external liquid circulation path to the supply port 81 is supplied to the pressure chamber 21 through the common supply channel 56, the supply opening 32, the intermediate supply channel 24, and the individual supply channel 22.

The liquid that is not discharged from the nozzle 11 by driving the piezoelectric element 42 flows from the pressure chamber 21 to the external liquid circulation path through the individual collection channel 23, the intermediate collection channel 25, the collection opening 33, the common collection channel 57, and the collection port 82.

Next, a configuration of the dummy channel 60 of the head 1 according to the fifth embodiment of the present disclosure is described with reference to FIG. 9. As illustrated in FIG. 1, the dummy channel 60 is arranged at an end of an array of the pressure chambers 21 in the nozzle array direction NAD. As illustrated in FIG. 9, the dummy channel 60 includes a dummy pressure chamber 61, a dummy individual supply channel 62, a dummy intermediate supply channel 64, a dummy individual collection channel 63, a dummy intermediate collection channel 65, and a dummy nozzle communication channel 67.

A shape of the dummy channel 60 as illustrated in FIG. 8 is the same as a shape of the pressure chamber 21, the individual supply channel 22, the intermediate supply channel 24, the nozzle communication channel 27, the individual collection channel 23, and the intermediate collection channel 25 as illustrated in FIG. 8. However, the shape of the dummy channel 60 may be different from the shape of the pressure chamber 21, the individual supply channel 22, and the intermediate supply channel 24, the nozzle communication channel 27, the individual collection channel 23, and the intermediate collection channel 25 as illustrated in FIG. 8.

The nozzle plate 10 does not include the nozzle 11 in a portion corresponding to the dummy pressure chamber 61. A part of the wall of the dummy pressure chamber 61 is formed by a dummy vibration region 71 of the diaphragm 30. The dummy vibration region 71 includes a convex portion 71*a*, and the dummy piezoelectric element 44 is bonded to the convex portion 71*a*.

Figure 10:
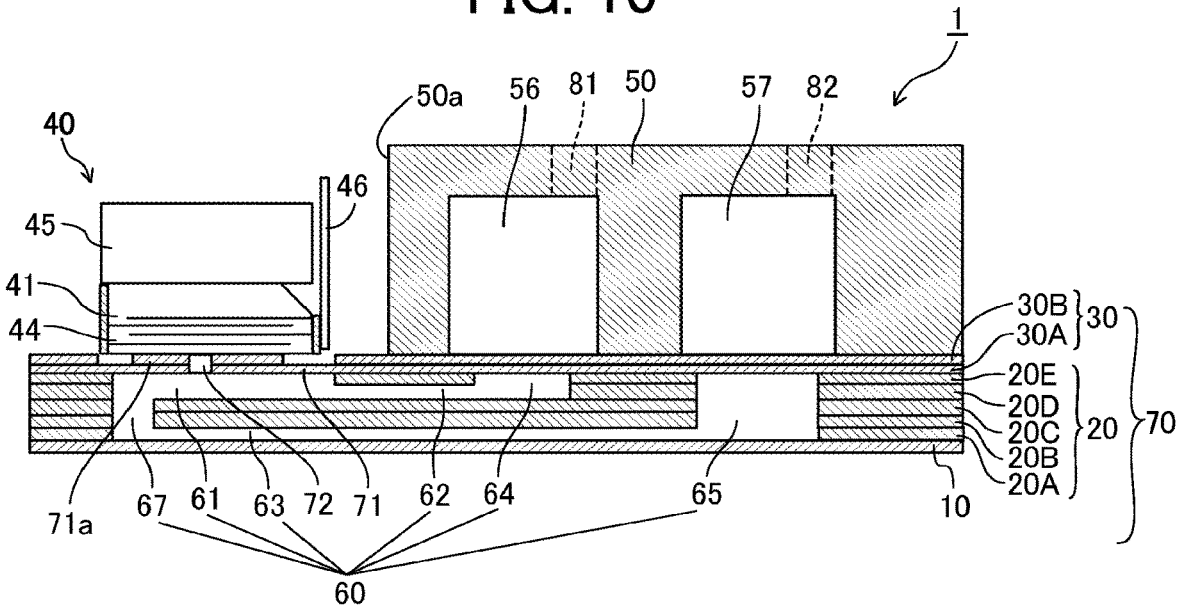
FIG. 10 is a cross-sectional view of the liquid discharge head at a position of the dummy pressure chamber of the liquid discharge head according to a sixth embodiment along the direction perpendicular to the nozzle array direction.

Further, the head 1 in the fifth embodiment includes the common supply channel 56 and the common collection channel 57 formed up to positions of the dummy intermediate supply channel 64 and the dummy intermediate collection channel 65 in the nozzle array direction NAD. However, as illustrated in FIG. 10, the diaphragm 30 insulates the common supply channel 56 from the dummy intermediate supply channel 64. Further, the diaphragm 30 insulates the common collection channel 57 from the dummy intermediate collection channel 65.

Thus, the dummy channel 60 does not communicate with the nozzle 11 and is a space to which no liquid is supplied.

Further, the head 1 according to the fifth embodiment includes the through hole 72 in the dummy vibration region 71 of the diaphragm 30 as in the head 1 according to the first embodiment as illustrated in FIG. 3. The through hole 72 communicates with a space (atmosphere) in an insertion port 50*a* of the piezoelectric actuator 40 in the common channel member 50.

Thus, the head 1 according to the fifth embodiment can reduce the liquid from entering into the through hole 72 serving as the air release port.

Next, the head 1 according to a sixth embodiment of the present disclosure is described with reference to FIG. 10. FIG. 10 is a cross-sectional view of the head 1 at a position of the dummy pressure chambers 61 of the head 1 according to the sixth embodiment along the direction perpendicular to the nozzle array direction NAD.

The head 1 according to the sixth embodiment includes the through hole 72 in the dummy vibration region 71 of the diaphragm 30 as in the head 1 according to the second embodiment as illustrated in FIG. 5.

After the nozzle plate 10, the channel plate 20, and the diaphragm 30 are bonded with an adhesive to form the channel unit 70, the dummy piezoelectric element 44 is bonded to the convex portion 71*a* of the dummy vibration region 71 of the diaphragm 30 with an adhesive. The through hole 72 used as the air release port is thus sealed (closed) by the dummy piezoelectric element 44 bonded to the convex portion 71*a* of the dummy vibration region 71. Thus, the dummy channel 60 is a sealed space (closed space) after the through hole 72 is sealed by the dummy piezoelectric element 44.

Thus, the head 1 according to the six embodiment can obtain the same effect as the effect of the head 1 according to the second embodiment. The through hole 72 may have a configuration in which the opening area gradually decreases toward the wall surface of the dummy channel 60.

Figure 11:
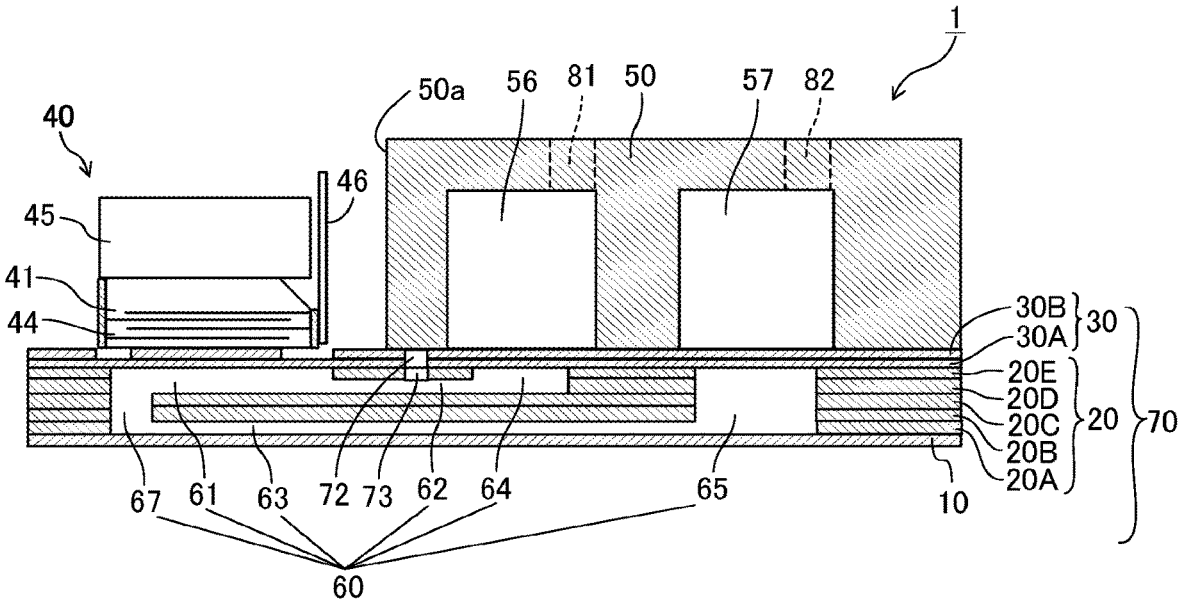
FIG. 11 is a cross-sectional view of the liquid discharge head at a position of the dummy pressure chamber of the liquid discharge head according to a seventh embodiment along the direction perpendicular to the nozzle array direction.

Next, the head 1 according to a seventh embodiment of the present disclosure is described with reference to FIG. 11. FIG. 11 is a cross-sectional view of the head 1 at a position of the dummy pressure chambers 61 of the head 1 according to the seventh embodiment along the direction perpendicular to the nozzle array direction NAD.

The head 1 according to the seventh embodiment includes the through hole 72 in the diaphragm 30 such that the through hole 72 communicates the dummy individual supply channel 62 with the atmosphere when the common channel member 50 is not bonded to the diaphragm 30 as in the head 1 according to the fourth embodiment as illustrated in FIG. 7. The plate member 20E forming the channel plate 20 includes the communication hole 73 to connect the through hole 72 and the dummy individual supply channel 62.

After the nozzle plate 10, the channel plate 20, and the diaphragm 30 are bonded with an adhesive to form the channel unit 70, the common channel member 50 is bonded to the diaphragm 30 with an adhesive. The through hole 72 used as the air release port is thus sealed (closed) by the common channel member 50 bonded to the diaphragm 30. Thus, the dummy channel 60 is a sealed space (closed space) after the through hole 72 is sealed by the common channel member 50.

Thus, the head 1 according to the seventh embodiment can obtain the same effect as the effect of the head 1 according to the fourth embodiment.

Figure 12:
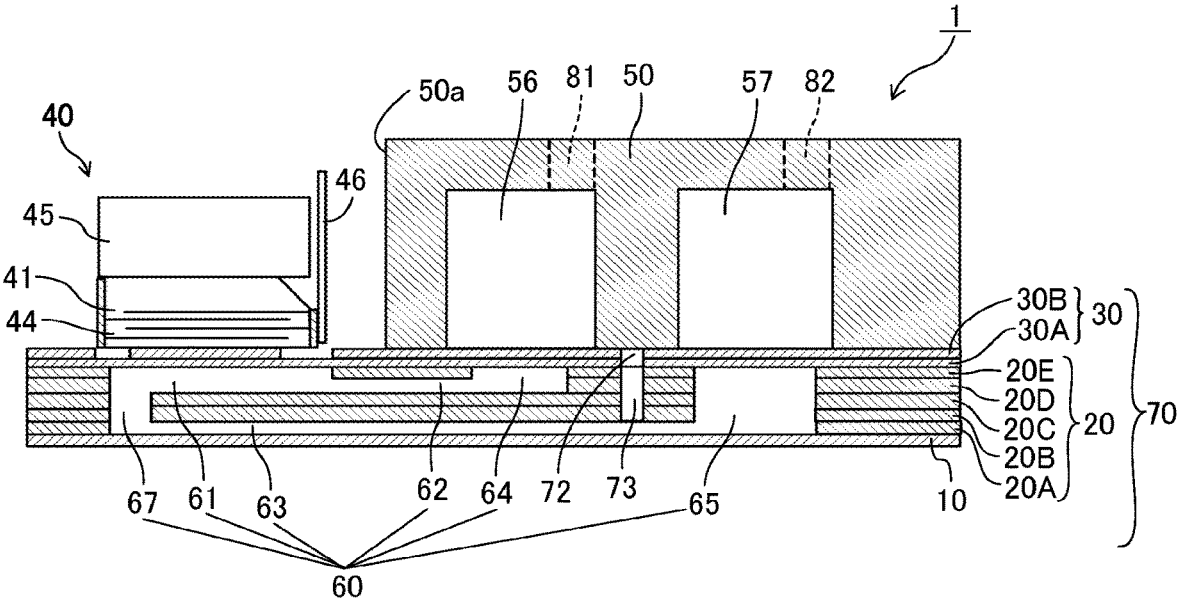
FIG. 12 is a cross-sectional view of the liquid discharge head at a position of the dummy pressure chamber of the liquid discharge head according to an eighth embodiment along the direction perpendicular to the nozzle array direction.

Next, the head 1 according to an eighth embodiment of the present disclosure is described with reference to FIG. 12. FIG. 12 is a cross-sectional view of the head 1 at a position of the dummy pressure chambers 61 of the head 1 according to the eighth embodiment along the direction perpendicular to the nozzle array direction NAD.

The head 1 according to the eighth embodiment includes the through hole 72 in the diaphragm 30 such that the through hole 72 communicates the dummy individual collection channel 63 with the atmosphere when the common channel member 50 is not bonded to the diaphragm 30. The plate members 20B to 20E forming the channel plate 20 include the communication hole 73 to connect the through hole 72 and the dummy individual collection channel 63.

After the nozzle plate 10, the channel plate 20, and the diaphragm 30 are bonded with an adhesive to form the channel unit 70, the common channel member 50 is bonded to the diaphragm 30 with an adhesive. The through hole 72 used as the air release port is thus sealed (closed) by the common channel member 50 bonded to the diaphragm 30. Thus, the dummy channel 60 is a sealed space (closed space) after the through hole 72 is sealed by the common channel member 50.

Thus, the head 1 according to the eighth embodiment can obtain the same effect as the effect of the head 1 according to the seventh embodiment.

Figure 13:
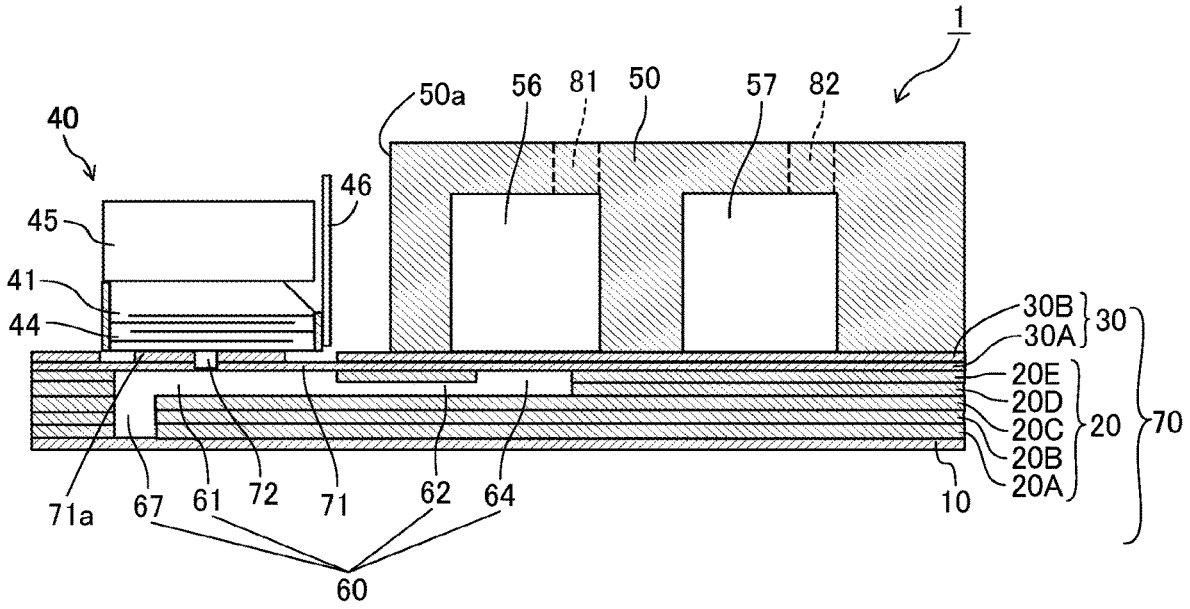
FIG. 13 is a cross-sectional view of the liquid discharge head at a position of the dummy pressure chamber of the liquid discharge head according to a ninth embodiment along the direction perpendicular to the nozzle array direction.

Next, the head 1 according to a ninth embodiment of the present disclosure is described with reference to FIG. 13. FIG. 13 is a cross-sectional view of the head 1 at a position of the dummy pressure chambers 61 of the head 1 according to the ninth embodiment along the direction perpendicular to the nozzle array direction NAD.

As illustrated in FIG. 9, the dummy channel 60 of the head 1 according to the ninth embodiment includes a dummy pressure chamber 61, a dummy individual supply channel 62, a dummy intermediate supply channel 64, and a dummy nozzle communication channel 67. However, the dummy channel 60 of the head 1 according to the ninth embodiment does not include the dummy individual collection channel 63 and the dummy intermediate collection channel 65 in the head 1 according to the fifth embodiment.

The head 1 according to the ninth embodiment includes the through hole 72 in the dummy vibration region 71 and the convex portion 71*a* of the diaphragm 30 as in the head 1 according to the sixth embodiment as illustrated in FIG. 10. The through hole 72 of the head 1 according to the ninth embodiment is sealed by the dummy piezoelectric element 44 bonded to the convex portion 71*a* of the diaphragm 30 as in the head 1 according to the fifth embodiment as illustrated in FIG. 10. Thus, the dummy channel 60 is a sealed space (closed space) after the through hole 72 is sealed by the dummy piezoelectric element 44.

Note that the configuration of the head 1 according to the fifth embodiment (see FIGS. 8 and 9), the seventh embodiment (see FIG. 11), or the eighth embodiment (see FIG. 12) may be employed to the head 1 according to the ninth embodiment.

That is, the head 1 having a circulation-type pressure chamber 21 does not include the dummy channel 60 corresponding to collection channels such that the dummy channel 60 of the head 1 according to the ninth embodiment does not include the dummy individual collection channel 63 and the dummy intermediate collection channel 65. The head 1 having such a configuration can achieve the same effects similar to the head 1 according to the fifth embodiment (see FIGS. 8 and 9) or the eighth embodiment (see FIG. 12).

Figure 14:
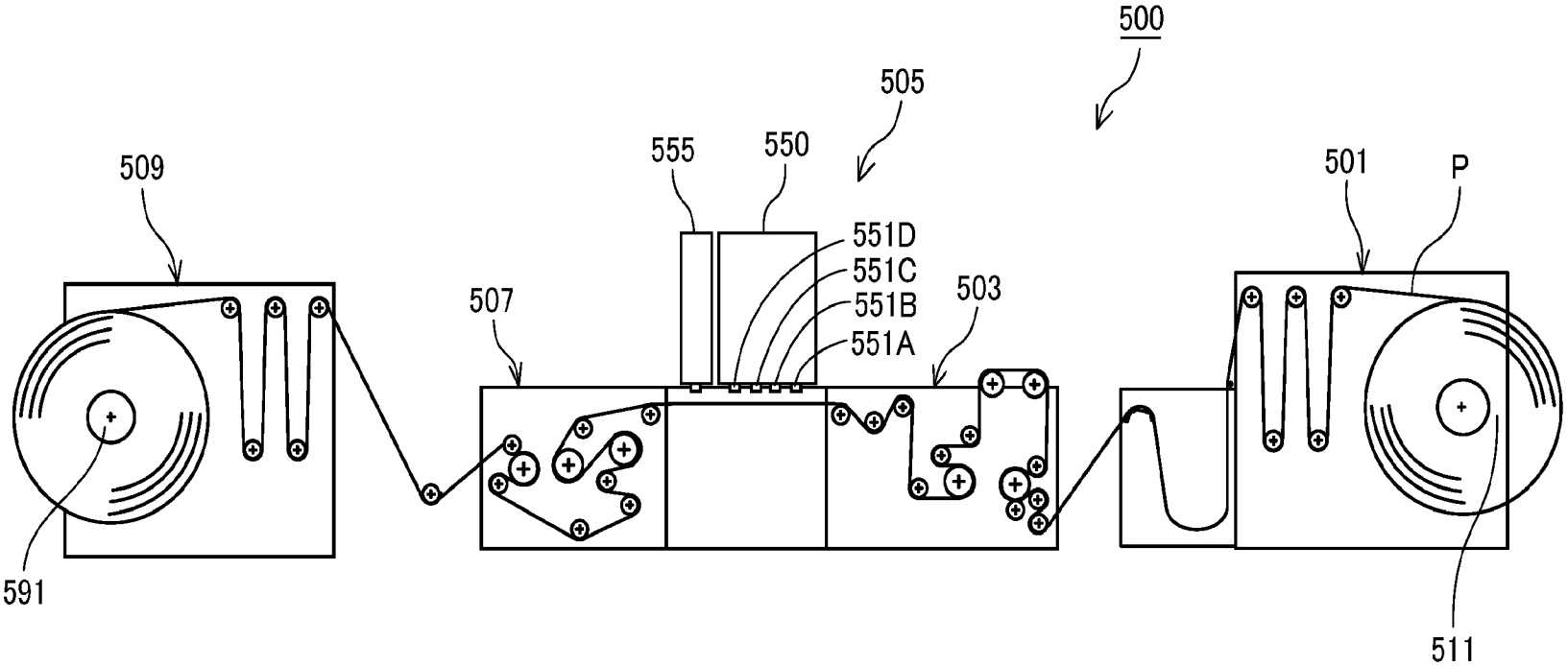
FIG. 14 is a schematic front view of a printer as a liquid discharge apparatus according to a tenth embodiment of the present disclosure.
Figure 15:
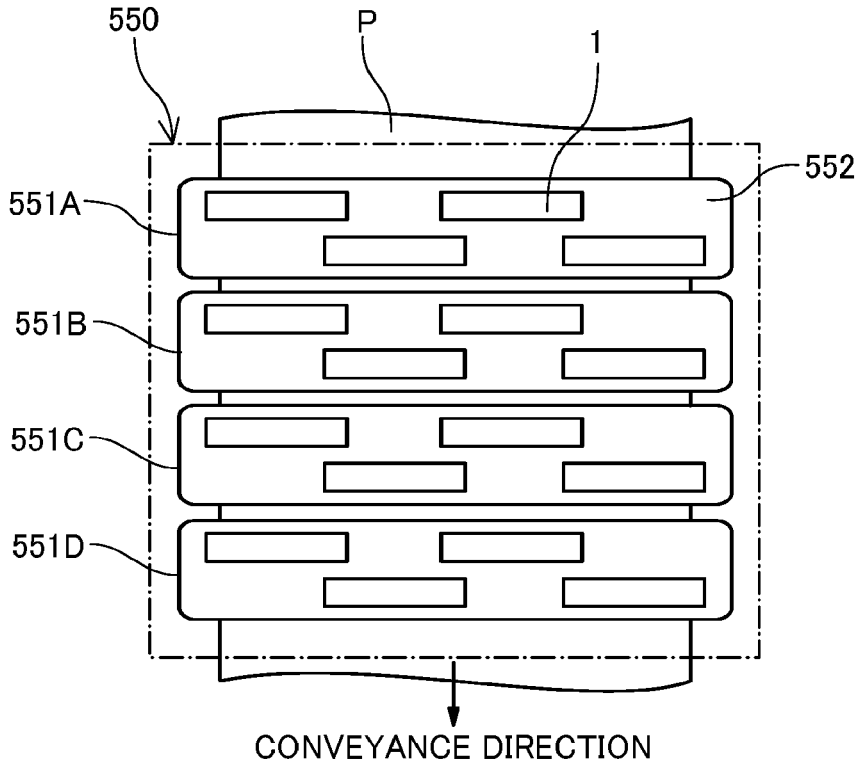
FIG. 15 is a plan view of an example of a liquid discharge device of the liquid discharge apparatus of FIG. 14.

Next, an example of a printer 500 serving as a liquid discharge apparatus according to a tenth embodiment is described with reference to FIGS. 14 and 15. FIG. 14 is a side view of the printer 500 as the liquid discharge apparatus according to the tenth embodiment of the present disclosure. FIG. 15 is a plan view of a head unit of the printer 500 as the liquid discharge apparatus of FIG. 14 according to the tenth embodiment.

The printer 500 is the liquid discharge apparatus including the head 1 to discharge a liquid on a medium to form an image on the medium. The printer 500 includes a loading device 501, a guide conveyor 503, a printing device 505, a drying device 507, and an ejection device 509. The loading device 501 loads a web-like sheet P. The guide conveyor 503 guides and conveys the sheet P loaded by the loading device 501 to the printing device 505.

The printing device 505 discharge a liquid onto the sheet P to form an image on the sheet P as a printing process. The drying device 507 dries the sheet P on which an image is formed by the printing device 505. The ejection device 509 ejects the sheet P conveyed from the drying device 507.

The sheet P is fed from a winding roller 511 of the loading device 501, guided and conveyed with rollers of the loading device 501, the guide conveyor 503, the drying device 507, and the ejection device 509, and wound around a take-up roller 591 of the ejection device 509.

In the printing device 505, the sheet P is conveyed so as to face the head device 550 and the head device 555. The head device 550 discharges the liquid onto the sheet P to form an image on the sheet P. The head device 555 discharges a treatment liquid onto the sheet P, on which an image is formed by the head device 550, to perform a post-treatment process.

The head device 550 includes, for example, four-color full-line head arrays 551A, 551B, 551C, and 551D from an upstream side in a conveyance direction of the sheet P from right to left in FIG. 14. Hereinafter, the four-color full-line head arrays 551A, 551B, 551C, and 551D are collectively referred to as "head arrays 551" unless colors are distinguished.

Each of the head arrays 551 is a liquid discharge device to discharge liquid of black (K), cyan (C), magenta (M), and yellow (Y) onto the sheet P conveyed in the conveyance direction of the sheet P. Note that number and types of color are not limited to the above-described four colors of K, C, M, and Y and may be any other suitable number and types.

In each head array 551, for example, as illustrated in FIG. 15, the heads 1 are staggered on a base 552 to form the head array 551. Note that the configuration of the head array 551 is not limited to such a configuration. The head 1 has a configuration of one of the head 1 illustrated in FIGS. 1 to 13 according to the first embodiment to the ninth embodiment as described above.

In the present embodiments, a "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply unit, a maintenance unit, a main scan moving unit, and a liquid circulation apparatus.

Here, examples of the "single unit" include a combination in which the head and a functional part(s) or unit(s) are secured to each other through, e.g., fastening, bonding, or engaging, and a combination in which one of the head and a functional part(s) or unit(s) is movably held by another. The head may be detachably attached to the functional part(s) or unit(s) s each other.

For example, the head and the head tank may form the liquid discharge device as a single unit. Alternatively, the head and the head tank coupled (connected) with a tube or the like may form the liquid discharge device as a single unit. Here, a unit including a filter may further be added to a portion between the head tank and the head of the liquid discharge device.

In another example, the head and the carriage may form the liquid discharge device as a single unit.

In still another example, the liquid discharge device includes the head movably held by a guide that forms part of a main scan moving unit, so that the head and the main scan moving unit form a single unit. The liquid discharge device may include the head, the carriage, and the main scan moving unit that form a single unit.

In still another example, a cap that forms a part of a maintenance unit may be secured to the carriage mounting the head so that the head, the carriage, and the maintenance unit form a single unit to form the liquid discharge device.

Further, in another example, the liquid discharge device includes tubes connected to the head mounting the head tank or the channel member so that the head and a supply unit form a single unit. Liquid is supplied from a liquid reservoir source to the head via the tube.

The main scan moving unit may be a guide only. The supply unit may be a tube(s) only or a loading unit only.

The term "liquid discharge apparatus" used herein also represents an apparatus including the head or the liquid discharge device to driving the head to discharge liquid. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle from which a liquid is discharged, and nozzle being a part of a nozzle array which defines a nozzle array direction;

a pressure chamber communicating with the nozzle, to which the liquid is supplied;

a dummy channel not communicating with the nozzle and adjacent to the pressure chamber, the dummy channel being a sealed place to which the liquid is not supplied; and a diaphragm configured to define a displaceable wall of the pressure chamber and a wall of the dummy channel, wherein the wall of the dummy channel defined by the diaphragm includes a through hole, and wherein the dummy channel is at an end of the pressure chamber in the nozzle array direction.

2. The liquid discharge head according to claim 1, wherein an opening area of the through hole gradually decreases toward the wall of the dummy channel.

3. The liquid discharge head according to claim 1, further comprising:

an individual supply channel communicating with the pressure chamber; and an individual collection channel communicating with the pressure chamber, wherein the dummy channel includes:

a dummy pressure chamber;

a dummy individual supply channel communicating with the dummy pressure chamber; and a dummy individual collection channel communicating with the dummy pressure chamber.

4. The liquid discharge head according to claim 1, further comprising:

a channel plate bonded to the diaphragm, the channel plate including the pressure chamber and the dummy channel, wherein the dummy channel includes:

a dummy pressure chamber; and a dummy individual supply channel communicating with the dummy pressure chamber, wherein the channel plate includes a communication hole communicating with the through hole and the dummy individual supply channel.

5. The liquid discharge head according to claim 1, further comprising:

a channel plate bonded to the diaphragm, the channel plate including the pressure chamber and the dummy channel, wherein the dummy channel includes:

a dummy pressure chamber;

a dummy individual supply channel communicating with the dummy pressure chamber; and a dummy individual collection channel communicating with the dummy pressure chamber, and the channel plate includes a communication hole communicating with the through hole and the dummy individual collection channel.

6. A liquid discharge device comprising:

the liquid discharge head according to claim 1.

7. A liquid discharge apparatus comprising:

the liquid discharge device according to claim 6.

8. A liquid discharge head comprising:

a nozzle from which a liquid is discharged;

a pressure chamber communicating with the nozzle, to which the liquid is supplied;

a dummy channel not communicating with the nozzle and adjacent to the pressure chamber, the dummy channel being a sealed place to which the liquid is not supplied; and a diaphragm configured to define a displaceable wall of the pressure chamber and a wall of the dummy channel, wherein the wall of the dummy channel defined by the diaphragm includes a through hole, wherein the through hole is sealed to seal the dummy channel.

9. The liquid discharge head according to claim 8, further comprising:

a piezoelectric element bonded to the displaceable wall of the pressure chamber; and a dummy piezoelectric element bonded to the wall of the dummy channel, wherein the dummy piezoelectric element seals the through hole.

10. The liquid discharge head according to claim 8, further comprising:

a common channel member including a common supply channel through which the liquid is supplied to the pressure chamber, wherein the common channel member seals the through hole.

11. A liquid discharge head comprising:

a nozzle from which a liquid is discharge;

a pressure chamber communicating with the nozzle, to which the liquid is supplied;

a dummy channel not communicating with the nozzle and adjacent to the pressure chamber, the dummy channel being a sealed place to which the liquid is not supplied; and a diaphragm configured to define a displaceable wall of the pressure chamber and a wall of the dummy channel, wherein the wall of the dummy channel defined by the diaphragm includes a through hole, the liquid discharge head further comprising:

an individual supply channel communicating with the pressure chamber; and an individual collection channel communicating with the pressure chamber, wherein the dummy channel includes:

a dummy pressure chamber; and a dummy individual supply channel communicating with the dummy pressure chamber.

12. A liquid discharge head comprising:

a nozzle from which a liquid is discharged;

a pressure chamber communicating with the nozzle, to which the liquid is supplied;

a dummy channel not communicating with the nozzle and adjacent to the pressure chamber, the dummy channel being a sealed place to which the liquid is not supplied; and a diaphragm configured to define a displaceable wall of the pressure chamber and a wall of the dummy channel, wherein the wall of the dummy channel defined by the diaphragm includes a through hole, the liquid discharge head further comprising:

a piezoelectric element bonded to the displaceable wall of the pressure chamber; and a dummy piezoelectric element bonded to the wall of the dummy channel, wherein a common channel member including a common supply channel through which the liquid is supplied to the pressure chamber, and wherein the through hole is between the dummy piezoelectric element and the common channel member.

* * * * *